US010116050B2

(12) United States Patent
Desclos et al.

(10) Patent No.: US 10,116,050 B2
(45) **Date of Patent: *Oct. 30, 2018**

(54) MODAL ADAPTIVE ANTENNA USING REFERENCE SIGNAL LTE PROTOCOL

(71) Applicant: Ethertronics, Inc., San Diego, CA (US)

(72) Inventors: Laurent Desclos, San Diego, CA (US); Sebastian Rowson, San Diego, CA (US); Jeffrey Shamblin, San Marcos, CA (US)

(73) Assignee: Ethertronics, Inc., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/671,506

(22) Filed: Aug. 8, 2017

(65) Prior Publication Data

US 2018/0040952 A1 Feb. 8, 2018

Related U.S. Application Data

(63) Continuation of application No. 15/261,840, filed on Sep. 9, 2016, now Pat. No. 9,761,940, which is a continuation-in-part of application No. 14/109,789, filed on Dec. 17, 2013, which is a continuation of application No. 13/548,895, filed on Jul. 13, 2012, now Pat. No. 8,633,863, which is a continuation-in-part of application No. 13/029,564, filed on Feb. 17, 2011, now Pat. No. 8,362,962, which is a continuation of application No. 12/043,090, filed on Mar. 5, 2008, now Pat. No. 7,911,402.

(51) Int. Cl.

| | |
|---|---|
| ***H01Q 1/24*** | (2006.01) |
| ***H01Q 21/12*** | (2006.01) |
| ***H01Q 3/26*** | (2006.01) |

(52) U.S. Cl.
CPC ..... *H01Q 3/2647* (2013.01); *H01Q 1/243* (2013.01); *H01Q 21/12* (2013.01)

(58) Field of Classification Search
CPC ..... H01Q 1/243; H01Q 21/12; H01Q 3/2647
See application file for complete search history.

(56) References Cited

U.S. PATENT DOCUMENTS

| | | | |
|---|---|---|---|
| 2,236,102 | A | 3/1941 | Kilster |
| 2,318,516 | A | 5/1943 | Newbold |
| 2,433,804 | A | 12/1947 | Wolff |
| 2,761,134 | A | 8/1956 | Tewsbury et al. |
| 2,938,208 | A | 5/1960 | Engel et al. |

(Continued)

*Primary Examiner* — Tho G Phan
(74) *Attorney, Agent, or Firm* — Dority & Manning, P.A.

(57) ABSTRACT

One or more input signals are used to generate a Pseudo noise generator and re-inject the signal to obtain a more efficient method of control of a receiver using adaptive antenna array technology. The antenna array automatically adjusts its direction to the optimum using information obtained from the input signal by the receiving antenna elements. The input signals may be stored in memory for retrieval, comparison and then used to optimize reception. The difference between the outputs of the memorized signals and the reference signal is used as an error signal. One or multiple Modal antennas, where the Modal antenna is capable of generating several unique radiation patterns, can implement this optimization technique in a MIMO configuration.

7 Claims, 7 Drawing Sheets

(56) References Cited

U.S. PATENT DOCUMENTS 3,419,869 A 12/1968 Altmayer
3,971,031 A 7/1976 Burke
4,390,902 A * 6/1983 Chin ..... H04N 5/50 348/564
4,536,797 A * 8/1985 Maturo ..... H04N 5/44513 348/570
5,165,109 A 11/1992 Han et al.
5,235,343 A 8/1993 Audren
5,444,498 A * 8/1995 Choo ..... H03J 7/04 348/733
5,485,167 A 1/1996 Wong et al.
5,568,155 A 10/1996 Tsunekawa
5,598,169 A 1/1997 Drabeck
5,777,581 A 7/1998 Lilly et al.
5,784,032 A 7/1998 Johnston et al.
5,797,086 A * 8/1998 Na ..... H04N 5/50 348/E5.097
5,874,919 A 2/1999 Rawnick
5,943,016 A 8/1999 Snyder et al.
5,999,138 A 12/1999 Ponce de Leon
6,104,349 A 8/2000 Cohen
6,326,921 B1 12/2001 Egorov
6,342,869 B1 1/2002 Edvardsson et al.
6,384,792 B2 5/2002 Apostolos
6,429,818 B1 8/2002 Johnson et al.
6,614,400 B2 9/2003 Egorov
6,717,549 B2 4/2004 Rawnick et al.
6,731,702 B1 * 5/2004 Nomura ..... H04L 27/2656 370/509
6,734,825 B1 5/2004 Guo et al.
6,765,536 B2 7/2004 Phillips
6,903,686 B2 6/2005 Vance et al.
6,987,493 B2 1/2006 Chen
7,068,234 B2 6/2006 Sievenpiper
7,081,854 B2 7/2006 Ying et al.
7,132,989 B1 11/2006 Poilasne
7,180,464 B2 2/2007 Chiang et al.
7,215,289 B2 5/2007 Harano
7,265,720 B1 9/2007 Ponce De Leon et al.
7,265,724 B1 11/2007 Tan et al.
7,330,156 B2 2/2008 Arkko et al.
7,333,057 B2 2/2008 Snyder
7,525,504 B1 4/2009 Song
7,616,163 B2 11/2009 Montgomery
7,619,574 B1 11/2009 West
7,696,928 B2 4/2010 Rowell
7,830,320 B2 11/2010 Shamblin et al.
7,834,813 B2 11/2010 Caimi
7,847,740 B2 12/2010 Dunn et al.
7,903,034 B2 3/2011 Anguera et al.
7,911,402 B2 3/2011 Rowson et al.
7,999,746 B2 8/2011 Cho
8,320,849 B2 11/2012 Nogami et al.
8,354,967 B2 1/2013 Huynh
8,446,318 B2 5/2013 Ali et al.
8,581,789 B2 11/2013 Desclos
8,604,988 B2 12/2013 Desclos et al.
9,231,669 B2 1/2016 Desclos
9,439,151 B2 9/2016 Zhu et al.
9,761,940 B2 * 9/2017 Desclos ..... H01Q 3/2647
2004/0027286 A1 2/2004 Poilasne
2004/0207559 A1 10/2004 Milosavljevic
2004/0227667 A1 11/2004 Sievenpiper
2005/0192727 A1 9/2005 Shostak
2005/0275596 A1 12/2005 Harano
2005/0285541 A1 12/2005 LeChevalier
2006/0220966 A1 10/2006 Sarychev
2007/0069958 A1 3/2007 Ozker
2007/0176824 A1 8/2007 Stumbo
2008/0001829 A1 1/2008 Rahola
2013/0040651 A1 2/2013 Derneryd et al.

* cited by examiner

MODAL ADAPTIVE ANTENNA USING REFERENCE SIGNAL LTE PROTOCOL

CROSS-REFERENCE TO RELATED APPLICATIONS

This application is a CON of U.S. patent application Ser. No. 15/261,840, filed Sep. 9, 2016;

which is a continuation in part (CIP) of U.S. Ser. No. 14/109,789, filed Dec. 13, 2013;

which is a CON of U.S. patent application Ser. No. 13/548,895, filed Jul. 13, 2012, now U.S. Pat. No. 8,633,863, issued Jan. 21, 2014;

which is a CIP of U.S. patent application Ser. No. 13/029,564, filed Feb. 17, 2011, and titled "Antenna and Method for Steering Antenna Beam Direction", now U.S. Pat. No. 8,362,962, issued Jan. 29, 2013;

which is a CON of U.S. patent application Ser. No. 12/043,090, filed Mar. 5, 2008, and titled "Antenna and Method for Steering Antenna Beam Direction", now U.S. Pat. No. 7,911,402, issued Mar. 22, 2011;

the contents of each of which are hereby incorporated by reference.

BACKGROUND OF THE INVENTION

Field of the Invention

This invention relates to wireless communication systems, and more particularly, to a modal adaptive antenna system and related signal receiving methods for long term evolution (LTE) networks.

Description of the Related Art

In a classical operation of a smart antenna system, the array input vectors are applied to multipliers forming the adaptive array, a summing circuit and an adaptive processor for adjusting the weights.

The signals are multiplied by weighted outputs from the adaptive processor. It takes a long period of time for the adaptive processor to process the calculations. Additionally, the adaptive processor is complicated. Consequently it is difficult to apply a classical scheme.

It is generally known in the art that these classical systems require extended periods of time for the adaptive processor to process calculations for signal receiving. Additionally, the circuit of the adaptive processor is complicated, and therefore it is difficult to apply the conventional smart antenna system to LTE mobile communications.

Modernly, it is therefore a requirement in the dynamic field of mobile communications to provide improved and more efficient methods of signal receiving and processing. Current trends and demand in the industry continue to drive improvements in signal receiving and processing for mobile LTE communications systems.

SUMMARY OF THE INVENTION

A single or multiple input signals are used to generate a Pseudo noise generator and re-inject the signal to obtain a more efficient method of control of a receiver using adaptive antenna array technology. The antenna array automatically adjusts its direction to the optimum using information obtained from the input signal by the receiving antenna elements. The input signals may be stored in memory for retrieval, comparison and then used to optimize reception.

The difference between the outputs of the memorized signals and the reference signal is used as an error signal. One or multiple Modal antennas, where the Modal antenna is capable of generating several unique radiation patterns, can implement this optimization technique in a MIMO configuration.

BRIEF DESCRIPTION OF THE DRAWINGS

These and other attributes of the invention are further described in the following detailed description of the invention, particularly when reviewed in conjunction with the drawings, wherein.

DETAILED DESCRIPTION

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

A multimode antenna, or "modal antenna", is described in commonly owned U.S. Pat. No. 7,911,402, issued Mar. 22, 2011, hereinafter referred to as the "'402 patent", the contents of which are incorporated by reference. The modal antenna of the '402 patent generally comprises an isolated magnetic dipole (IMD) element having one or more resonance portions thereof disposed above a circuit board to form a volume of the antenna. A first parasitic element is positioned between the IMD element and the circuit board within the volume of the antenna. A second parasitic element is positioned adjacent to the IMD element but outside of the antenna volume. Due to proximity of these parasitic elements and other factors, the first parasitic element is adapted to shift a frequency response of the antenna to actively tune one or more of the antenna resonance portions, and the second parasitic element is adapted to steer the antenna beam. In sum, the modal antenna of the '402 patent is capable of frequency shifting and beam steering. Moreover, where the antenna beam comprises a null, the null can be similarly steered such that the antenna can be said to be capable of null steering. For purposes of illustration, the modal antenna of the '402 patent provides a suitable example for use in the invention; however, it will be understood that other modal antennas may be used with some variation to the embodiments described herein.

Figure 1:
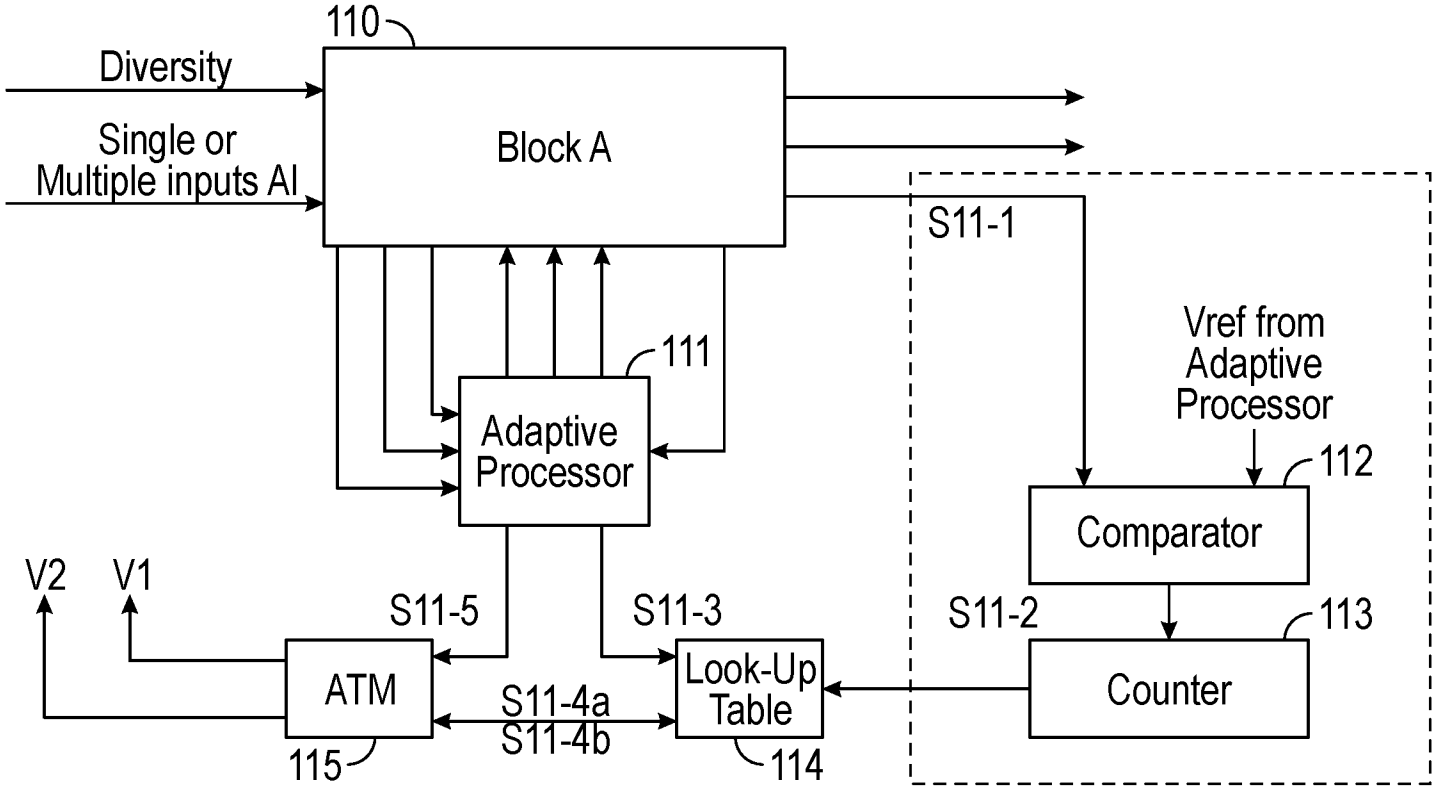
FIG. 1 shows an adaptive antenna system with a circuit block coupled to a comparator, counter, adaptive processor, automatic tuning module and lookup table, wherein the adaptive antenna system is configured to provide voltage signals for controlling active tuning components of a modal antenna for varying a corresponding radiation mode thereof.
Figure 2:
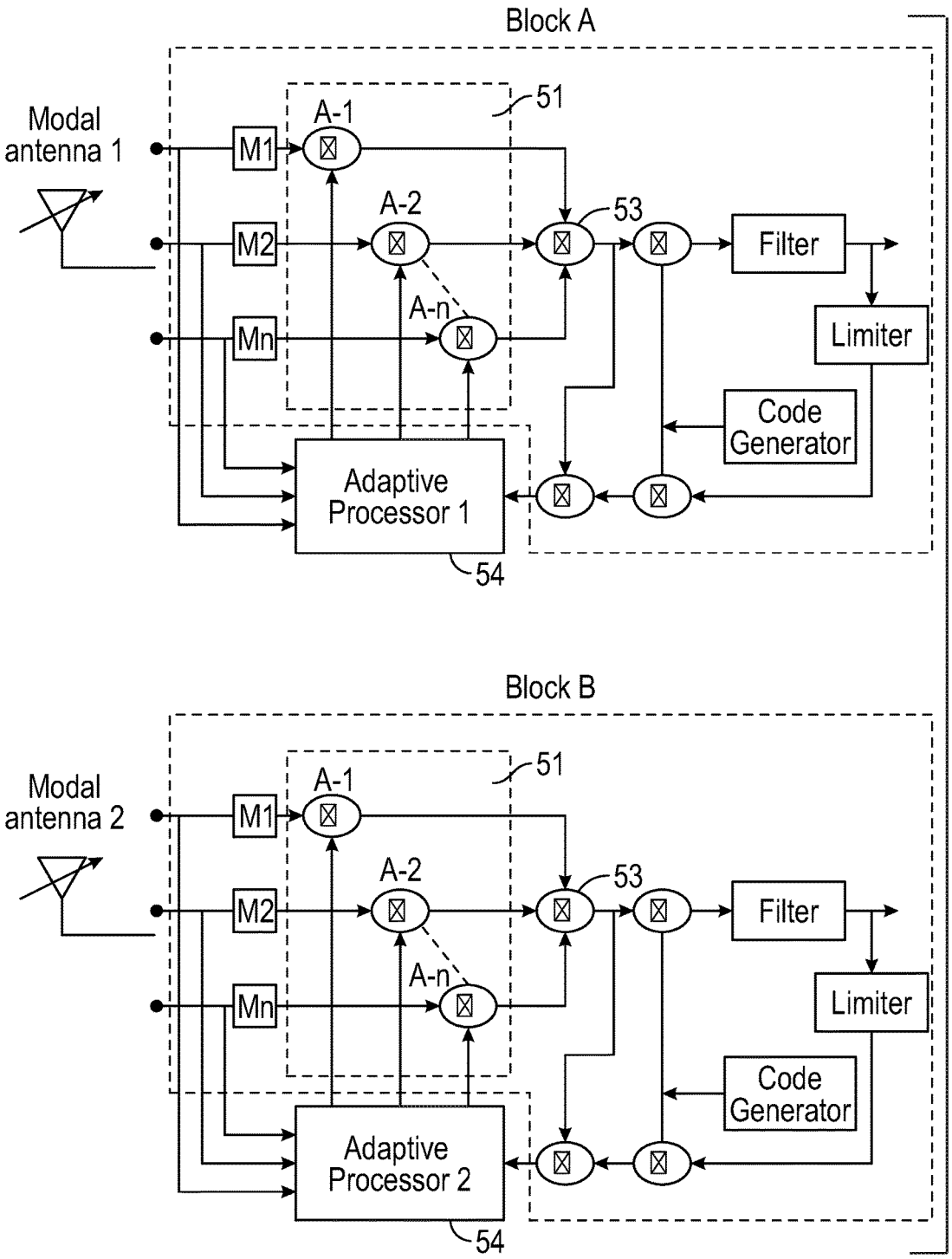
FIG. 2 shows a two-antenna array, each of the antennas includes a modal antenna, wherein each modal antenna is coupled to a circuit block and adaptive processor, each of the respective circuit blocks are illustrated with at least a summing circuit, filter, limiter, code generator.

Now turning to the drawings, FIG. 1 shows an antenna circuit (Block A is detailed in FIG. 2). An output S11-1 from Block A is compared with voltage reference signal $V_{ref}$ at comparator 112. The output of the comparator 112 increments or decrements a counter 113 based upon the comparator 112 output. The counter output signal S11-2 in conjunction with an output S11-3 from the adaptive processor 111, and a bi-directional signal S11-4*a* from the automatic tuning module 115, determine the output required from the look-up table 114. This resultant signal S11-4*b* in conjunction with signal S11-5 from the adaptive processor 111 are used to determine the outputs V1 and V2 from the automatic tuning module 115. See FIG. 6 for the physical representation of the application of V1 and V2.

FIG. 2 shows a modal antenna system for LTE communication, modal antenna 1 is coupled to Block A, and the combination provides "n" modes for use with the Block A circuit and the adaptive processor 1. A second modal antenna, Modal antenna 2, is shown coupled to a Block B and also provides "n" modes for use with the Block B circuit and adaptive processor 2. Note that "n" modes means any integer greater than one. This two-antenna system can be used in a MIMO antenna configuration.

Figure 3:
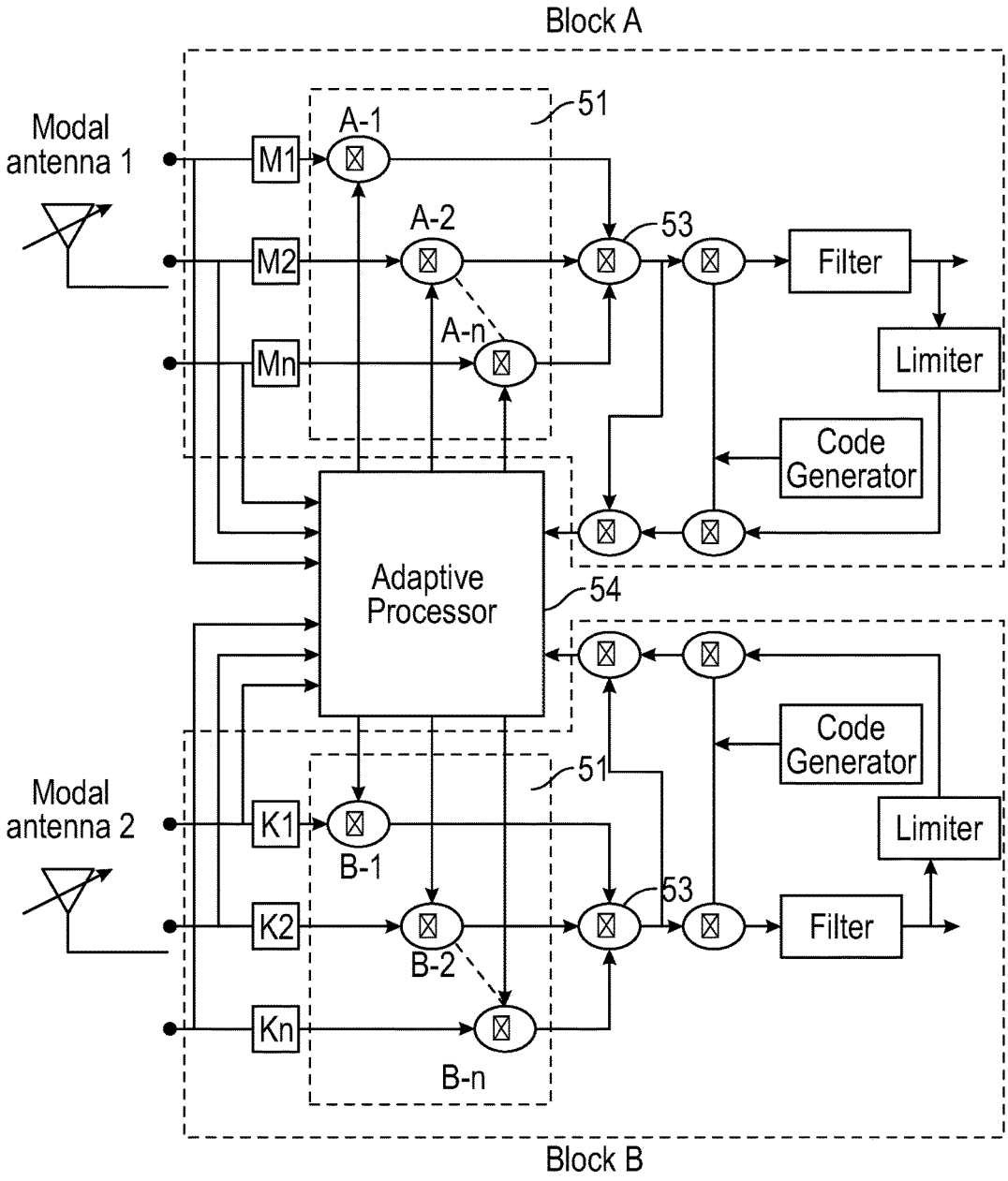
FIG. 3 shows a two-antenna array, each of the antennas includes a modal antenna, wherein each modal antenna is coupled to a circuit block, and each circuit block is coupled to a shared adaptive processor.

FIG. 3 illustrates another embodiment where a first modal antenna "Modal antenna 1" is coupled to circuit Block A and the combination provides "n" Modes for use with the Block A circuit. Modal antenna 2 is coupled to Block B and provides "n" modes for use with the Block B circuit. A common adaptive processor is used with the two-antenna configuration. One of the modes from Modal antenna 1 can be used as a reference signal for optimizing Modal antenna 2, and/or one of the Modes from Modal antenna 2 can be used to optimize Modal antenna 1. This two-antenna system can be used in a MIMO antenna configuration.

Figure 4:
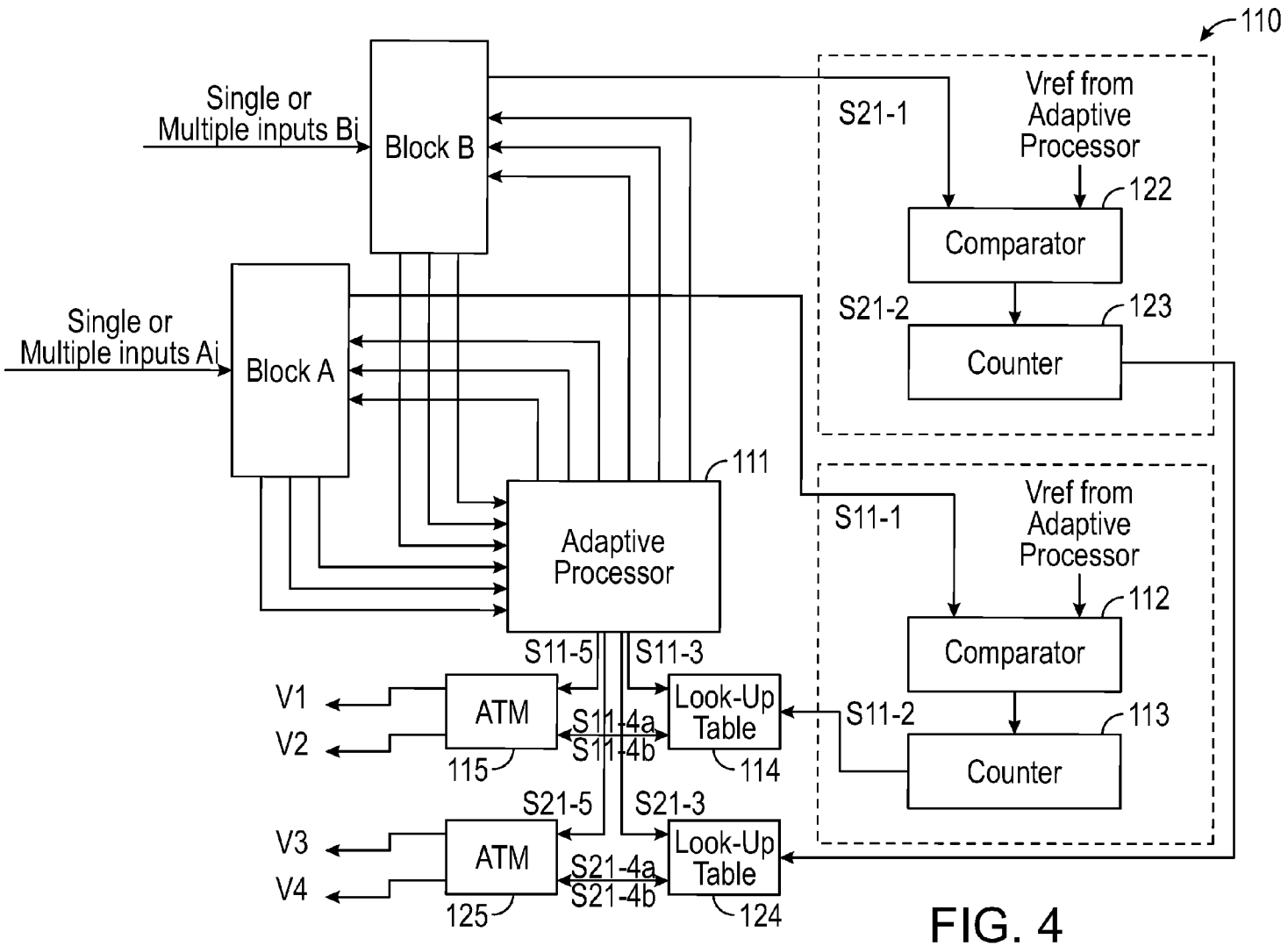
FIG. 4 shows a multi-input multi-output (MIMO) antenna processing system for providing voltage signals to active tuning components of a modal antenna.

FIG. 4 illustrates a multi-antenna Modal adaptive system. One or more inputs Ai are coupled to the Block A circuit and one or more inputs Bi are coupled to Block B circuit. The inputs Ai and Bi can be supplied by a Modal antenna.

One of the inputs Ai are used as a reference signal and fed to a comparator and compared with voltage reference signal $V_{ref}$ at first comparator 112. The output of the comparator 112 increments or decrements a counter 113 based upon the comparator 112 output. The counter output signal S11-2 in conjunction with an output S11-3 from the adaptive processor 111 and a bi-directional signal S11-4*a* from the automatic tuning module 115 determine the output required from the look-up table 114. This resultant signal 11-4*b* in conjunction with signal S11-5 from the Adaptive Processor 111 are used to determine the outputs V1 and V2 from the automatic tuning module 115. See FIG. 6 for the physical representation of the application of V1 and V2.

One of the inputs Bi are used as a reference signal and fed to a second comparator and compared with voltage reference signal $V_{ref}$ at second comparator 122. The output of the second comparator 122 increments or decrements a second counter 123 based upon the second comparator 122 output. The second counter output signal S21-2 in conjunction with an output S21-3 from the adaptive processor 111 and a second bi-directional signal 521-4*a* from the second automatic tuning module 125 determine the second output required from the second look-up table 124. This resultant signal 21-4*b* in conjunction with signal S21-5 from the adaptive processor 111 are used to determine the outputs V3 and V4 from the second automatic tuning module 125. See FIG. 6 for the physical representation of the application of V3 and V4.

Figure 5:
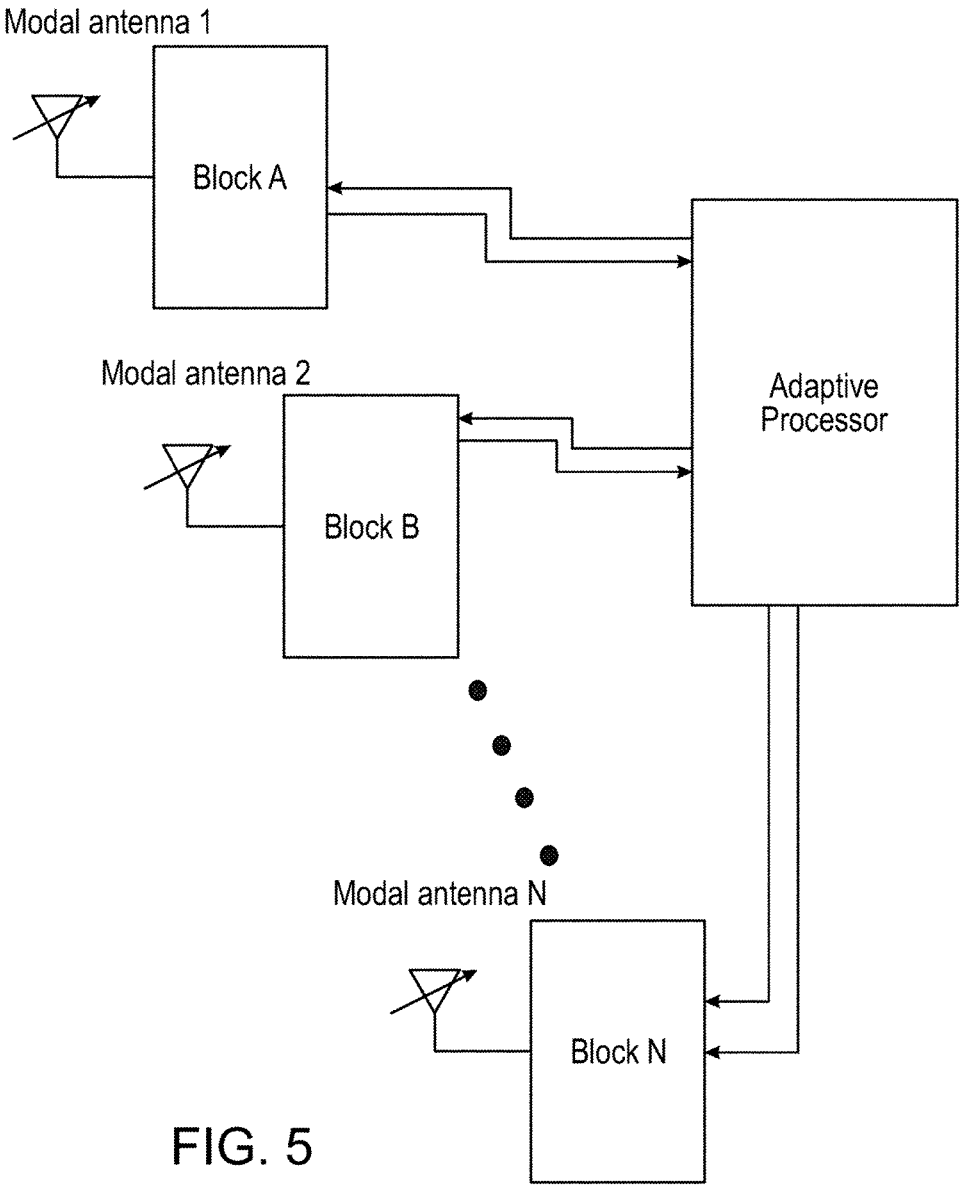
FIG. 5 shows up to "N" modal antennas and "N" circuit blocks can be combined with an adaptive processor to provide an N-element antenna array.

FIG. 5 shows an embodiment implementing "n" Modal antennas coupled to N Block circuits, respectively, with all Modal antenna/Block circuits controlled by a single adaptive processor, thereby forming an "n" Modal antenna array.

Figure 6:
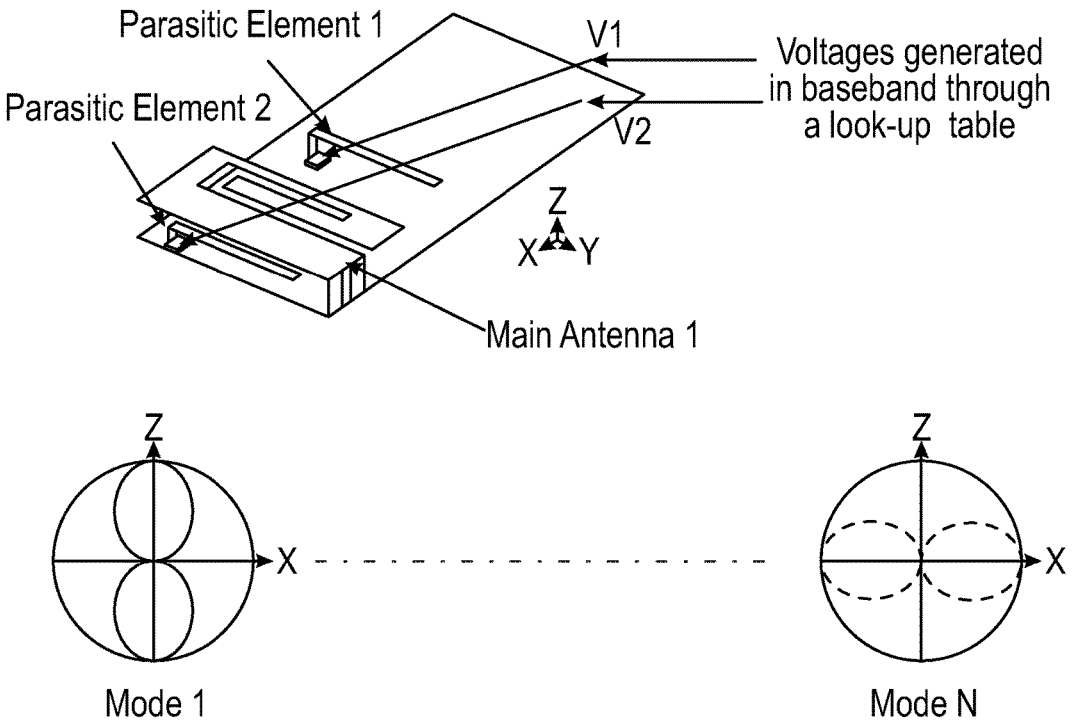
FIG. 6 shows a modal antenna including a main antenna element (radiating element) and two parasitic elements each coupled to a corresponding active tuning component, wherein voltages are used to alter a state of the active tuning components and associated parasitic elements.

FIG. 6 illustrates an exemplary physical example of a Modal antenna with voltages V1 and V2 applied to parasitic elements 1 and 2 used to modify the angle of maxima and/or minima of the radiation pattern (or any other parameters driving the antenna performance) for the Main Antenna 1 (radiating element) as shown for Mode 1 through Mode N. The voltages V1 and V2 are derived from a look-up table and are generated based upon changes in the input signals utilizing the methods described herein.

Figure 7:
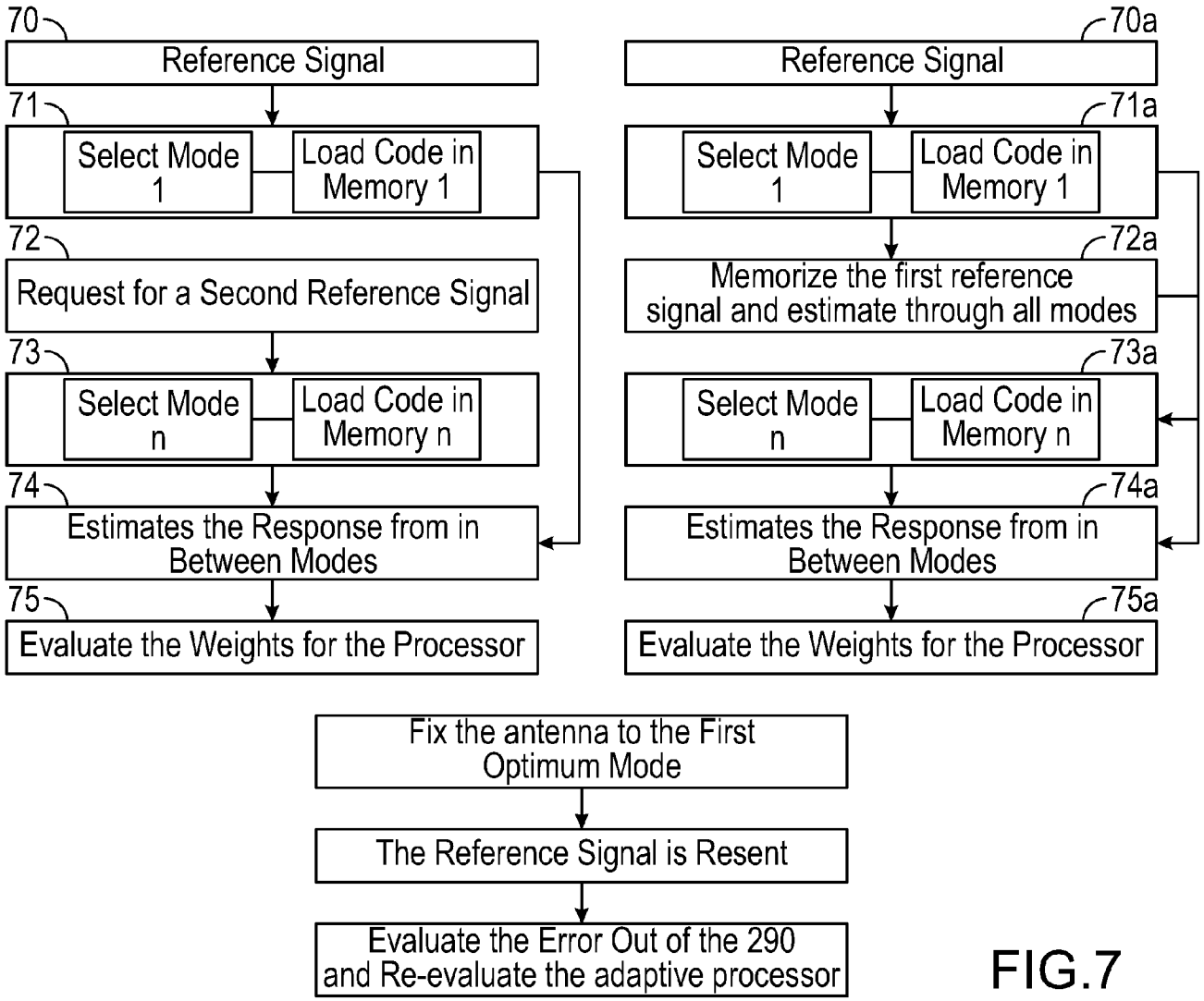
FIG. 7 shows a process for optimizing the antenna system.

FIG. 7 illustrates a flow diagram describing the process of sampling the response from the multiple antenna modes and developing weights for each mode. A pilot signal 70 is received when the antenna mode 71 is set to the first mode. A second pilot signal 72 is sampled with the antenna set to the second mode 73 and this process is repeated until all modes have been sampled. An estimation of antenna performance that occurs between sampled modes 74 is made. Weights are evaluated for the processor 75 based upon the sampled antenna responses for the various modes n. The adaptive process is highlighted starting in 70*a* where a pilot signal is received for antenna mode 1 71*a*. The receive response is stored and compared to previous received responses for mode 1 and estimates are made for receive response for the other antenna modes 72*a* and 73*a*. An estimate of antenna performance between sampled modes is performed 74*a*. Weights are evaluated for the processor 75*a* based on the sampled and estimated antenna response for the modes.

While the invention has been shown and described with reference to one or more certain preferred embodiments thereof, it will be understood by those having skill in the art that various changes in form and details may be made therein without departing from the spirit and scope of the invention as defined by the appended claims.

What is claimed is:

1. A multi-input multi-output (MIMO) antenna processing system comprising:

a first automatic tuning module configured to communicate first voltage signals to active components associated with a first modal antenna, wherein a first input of the first automatic tuning module is generated from a first lookup table and a second input of the first automatic tuning module is communicated from a first adaptive processor; and a second automatic tuning module configured to communicate second voltage signals to active components associated with a second modal antenna, wherein a first input of the second automatic tuning module is generated from a second lookup table and a second input of the second automatic tuning module is communicated from one of: the first adaptive processor or a second adaptive processor.

2. The MIMO antenna processing system of claim 1, wherein the first adaptive processor is coupled to a first circuit block.

3. The MIMO antenna processing system of claim 2, wherein the first adaptive processor is further coupled to a second circuit block.

4. The MIMO antenna processing system of claim 3, wherein the system is configured to store error signals outputted from the first adaptive processor in memory for retrieval and comparison to optimize antenna modes related to the first and second circuit blocks.

5. The MIMO antenna processing system of claim 4, wherein reference signals from the first and second circuit blocks are used to generate additional signals for controlling the first adaptive processor.

6. The MIMO antenna processing system of claim 2, wherein the second adaptive processor is further coupled to a second circuit block.

7. The MIMO antenna processing system of claim 6, further comprising:

the first circuit block coupled to a first comparator and first counter, the first comparator configured to receive inputs from the first circuit block and compare with a reference voltage communicated to the first comparator from the adaptive processor, the first counter is configured to receive a first comparator output signal from the first comparator, and a first counter output of the first counter is configured for communication with the first automatic tuning module and the lookup table associated; and the second circuit block coupled to a second comparator and second counter, the second comparator configured to receive inputs from the second circuit block and compare with a reference voltage communicated to the second comparator from the adaptive processor, the second counter is configured to receive a second comparator output signal from the second comparator, and a second counter output of the second counter is configured for communication with the second automatic tuning module and the lookup table associated;

wherein the first voltage signals associated with the first automatic tuning module are determined from the lookup table based on a combination of the first counter output signal, a first output signal associated with the adaptive processor, and a first bi-directional signal associated with the first automatic tuning module; and wherein the second voltage signals associated with the second automatic tuning module are determined from the lookup table based on a combination of the second counter output signal, a second output signal associated with the adaptive processor, and a second bi-directional signal associated with the second automatic tuning module.

* * * * *